US008596333B2

(12) United States Patent
Aoyama et al.

(10) Patent No.: US 8,596,333 B2
(45) Date of Patent: Dec. 3, 2013

(54) METHOD OF MAKING COPPER WIRE ROD WITH LOW SEMI-SOFTENING TEMPERATURE, METHOD OF MAKING COPPER WIRE AND COPPER WIRE

(75) Inventors: Seigi Aoyama, Kitaibaraki (JP); Toru Sumi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 183 days.

(21) Appl. No.: 12/659,453

(22) Filed: Mar. 9, 2010

(65) Prior Publication Data

US 2010/0230069 A1 Sep. 16, 2010

(30) Foreign Application Priority Data

Mar. 10, 2009 (JP) ..... 2009-056586
Jan. 22, 2010 (JP) ..... 2010-011521

(51) Int. Cl.
*B22D 11/00* (2006.01)
*C22B 15/00* (2006.01)

(52) U.S. Cl.
USPC ..... 164/462; 164/463; 164/476; 164/477; 75/646

(58) Field of Classification Search
USPC ..... 164/462, 423, 476, 477; 75/646, 653
See application file for complete search history.

(56) References Cited

U.S. PATENT DOCUMENTS

| | | | | |
|---|---|---|---|---|
| 4,290,823 | A * | 9/1981 | Dompas | 148/508 |
| 7,947,133 | B2 * | 5/2011 | Mihara et al. | 148/435 |
| 2005/0262968 | A1 * | 12/2005 | Asao et al. | 75/646 |

FOREIGN PATENT DOCUMENTS

| | | |
|---|---|---|
| JP | 2006-272422 | 10/2006 |
| JP | 2006-274383 | 10/2006 |
| JP | 2007-46102 | 2/2007 |
| WO | WO 2008032738 A1 * | 3/2008 |

* cited by examiner

*Primary Examiner* — Kevin P Kerns
*Assistant Examiner* — Steven Ha
(74) *Attorney, Agent, or Firm* — McGinn Intellectual Property Law Group, PLLC

(57) ABSTRACT

A method of making a copper wire rod with low semi-softening temperature includes melting a raw material copper to have a copper melt, adjusting concentrations of oxygen and sulfur included in the copper melt to be not more than 20 ppm and not more than 6 ppm, respectively, continuously casting the adjusted copper melt at temperature not higher than 1120° C. to have a cast bar, and hot-rolling the cast bar in a temperature range of 850° C. to 550° C.

9 Claims, 1 Drawing Sheet

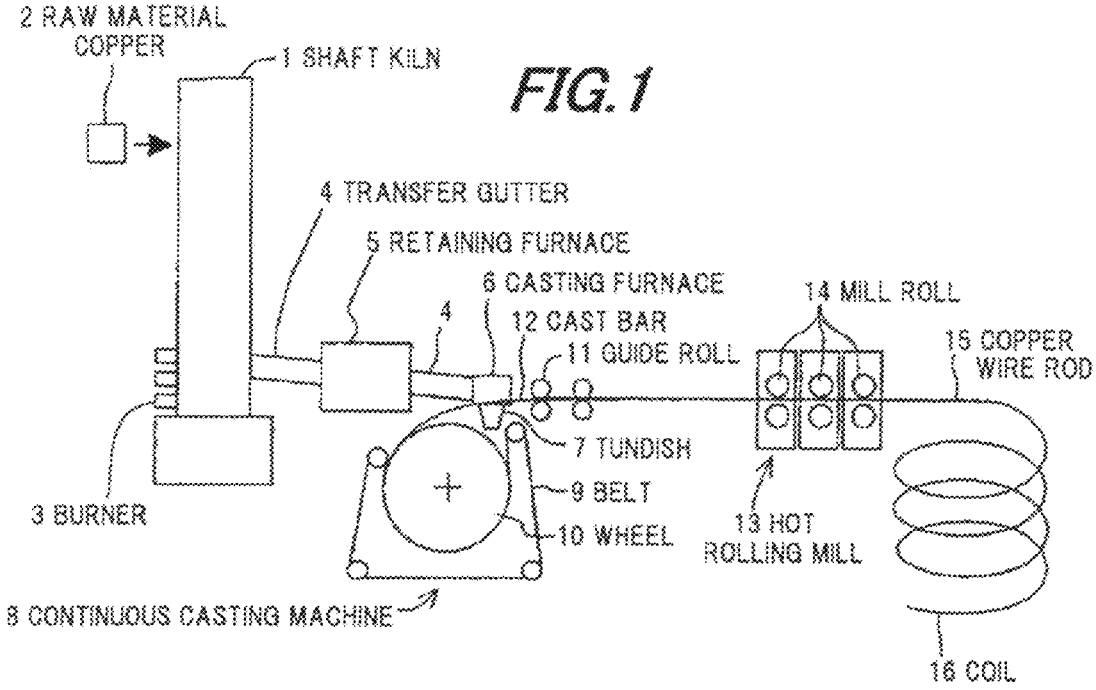
FIG. 2A
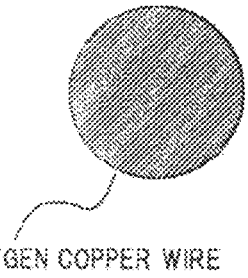
FIG. 2B
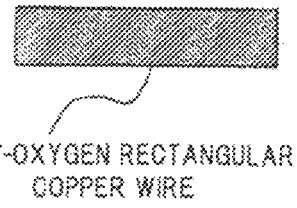

METHOD OF MAKING COPPER WIRE ROD WITH LOW SEMI-SOFTENING TEMPERATURE, METHOD OF MAKING COPPER WIRE AND COPPER WIRE

The present application is based on Japanese patent application Nos. 2009-056586 and 2010-011521 filed on Mar. 10, 2009 and Jan. 22, 2010, respectively, the entire contents of which are incorporated herein by reference.

BACKGROUND OF THE INVENTION

1. Field of the Invention

This invention relates to a method of making a copper wire rod with low semi-softening temperature by continuous casting and rolling method, a method of making a copper wire by using the copper wire rod made by the above method, and a copper wire with low semi-softening temperature made by the above method.

2. Description of the Related Art

Most of copper wires including electrical copper wires are manufactured by a method using the continuous casting and rolling method. The manufacturing method is conducted such that a relatively large copper wire rod is made using a copper melt obtained by melting a raw material copper, the copper wire rod as a matrix material is drawn in separate processing and appropriately annealed to have a copper wire with a predetermined size.

In the continuous casting and rolling method, the copper melt is obtained by melting the raw material copper such as electrolytic copper, scrap copper etc. in a melting furnace such as a shaft kiln, and supplied to a continuous casting machine of belt caster type via a transfer gutter and a retaining furnace etc. for continuous casting. Then a cast bar thus obtained is hot-rolled and then cooled to have a copper wire rod with a predetermined size. Thus, the continuous casting and rolling method can be implemented with continuous lines for melting, casting and rolling the raw material copper, so that it is very efficient and excellent in productivity as the production method of copper wire rod.

The copper wire rods to be obtained by the continuous casting and rolling include a oxygen-free copper wire and a tough pitch copper wire. However, the oxygen-free copper wire is generally difficult to make industrially by using the continuous casting and rolling method. For example, technical problems reside in the selection of the raw material copper (i.e., scrap copper cannot be used because of its high oxygen content), and in that all steps have to be strictly kept at non-oxidation atmosphere (otherwise, oxygen will be absorbed in the melt to increase the oxygen concentration so as not to gain the oxygen-free copper). Thus, producing the oxygen-free copper by the continuous casting and rolling method is apparently disadvantageous in cost as compared to producing the tough pitch copper by the continuous casting and rolling method.

On the other hand, when the copper wire is produced such that the copper wire rod made by the continuous casting and rolling method is used as a matrix material, drawn and annealed, the productivity of the copper wire can be enhanced by conducting continuously the drawing and annealing steps. In this case, it is very important to use a wire drawing matrix material (i.e., copper wire rod) with low softening temperature.

In other words, where the drawing step and the annealing step are continuously conducted, if the annealing temperature of the wire drawing matrix material increases, problems arise that it takes a long time for the annealing and that the production speed at the drawing step has to be synchronous with the prolonged production speed at the annealing step so that the productivity of the copper wire lowers. In addition, if the annealing temperature of the wire drawing matrix material increases, thermal energy needed for the annealing increases such that an increase in the product cost is caused. Thus, in order to inexpensively produce the copper wire by the excellent productivity method, it is very important to use a copper wire rod with low annealing temperature, i.e., low softening temperature as the wire drawing matrix material.

In order to decrease the softening temperature of a copper material including the copper wire rod, impurity elements included in the copper material has to be removed to increase the copper purity of the copper material. For example, methods for removing the impurity elements included in the copper material may include selecting the raw material copper (i.e., using high-purity copper), oxidation refining (or reduction refining) of copper melt obtained by melting the raw material copper etc.

However, these methods for removing the impurity elements all have a problem that a considerable increase in the product cost is caused. Although the oxidation refining or reduction refining are one of options that can be considered when tough pitch copper is used as the raw material copper, they are economically disadvantageous in terms of the casting technique and unsuitable industrially. Meanwhile, the production method of copper wire rod by the continuous casting and rolling method is very advantageous industrially and economically since good scrap copper containing tough pitch copper can be used (or recycled) as the raw material copper.

It is known that the alternative method for reducing the softening temperature of a copper material is to lower the concentration of some kind of element of the impurity elements included in the copper material. The some kind of element may be sulfur (S) that can be included as being solved in copper. A method of vacuum degassing the copper melt is tried for reducing the concentration of sulfur solved in copper. However, in this method, it is impossible to sufficiently decrease (or deposit) the sulfur solved in copper so that the softening temperature of the copper material cannot be reduced sufficiently.

JP-A-2006-272422 and JP-A-2006-274383 disclose a method of making a copper material (copper wire rod) with low softening temperature, wherein a metal (sulfur affinity metal) with a strong affinity for sulfur containing a metal or an alloy selected from Nb, Ti, Zr, V, Ta, Fe, Ca, Mg and Ni is added at a predetermined rate to a copper melt using the tough pith copper as a raw material copper, and the added metal is reacted with sulfur (S) included in the melt of tough pitch copper for depositing the sulfur as a sulfide such that the concentration of sulfur solved in the copper is reduced to lower the softening temperature of the copper material.

JP-A-2007-046102 discloses a method of making an oxygen-free copper wire with low annealing softening start temperature and semi-softening temperature, wherein an oxygen-free copper melt using a specific oxygen-free copper as a raw material copper is continuously cast into an ingot with a large cross section, the ingot is then hot-rolled into a wire rod, the wire rod is subjected to reduction in area to form a lot of sites with high strain as recrystallization nuclei.

However, as mentioned earlier, in the method of vacuum degassing the copper melt for reducing the concentration of sulfur solved in copper, it is impossible to sufficiently decrease (or deposit) the sulfur solved in copper so that the softening temperature of the copper material cannot be reduced sufficiently.

Although JP-A-2006-272422 and JP-A-2006-274383 disclose the method that a metal (sulfur affinity metal) with a strong affinity for sulfur containing a metal such as Nb is added at a predetermined rate to a copper melt using the tough pith copper, and the added metal is reacted with sulfur (S) included in the copper material for depositing the sulfur as a sulfide such that the concentration of sulfur solved in the copper is reduced to lower the softening temperature of the copper material, it is necessary to add the metal with the strong affinity for sulfur to the copper melt.

Although JP-A-2007-046102 discloses the method that the oxygen-free copper melt is continuously cast into the ingot with a large cross section, it is necessary to use the expensive oxygen-free copper as a raw material.

SUMMARY OF THE INVENTION

It is an object of the invention to provide a method of making a copper wire rod with low softening temperature that can sufficiently lower the softening temperature of a copper material at low cost, i.e., without adding the metal with a strong affinity for sulfur and using the expensive oxygen-free copper as a raw material.

It is a further object of the invention to provide a method of making a copper wire by using the copper wire rod made by the method, and a copper wire with low semi-softening temperature made by the method.

(1) According to one embodiment of the invention, a method of making a copper wire rod with low semi-softening temperature comprises:

melting a raw material copper to have a copper melt;

adjusting concentrations of oxygen and sulfur included in the copper melt to be not more than 20 ppm and not more than 6 ppm, respectively;

continuously casting the adjusted copper melt at temperature not higher than 1120° C. to have a cast bar; and hot-rolling the cast bar in a temperature range of 850° C. to 550° C.

In the above embodiment (1), semi-softening temperature is defined as heating temperature corresponding to an average value of a tensile strength before the heating of a copper wire and a tensile strength after the heating of the copper wire, in a heating-softening curve that shows the relationship between heating temperature (heating time of 1 hour) and tensile strength with respect to the copper wire. In other words, the semi-softening temperature is a heating temperature corresponding to a tensile strength of the copper wire being reduced to nearly half by the heating.

In the above embodiment (1), the raw material copper may be a low-oxygen copper, a tough pitch copper. The low-oxygen copper and the tough pitch copper are industrially in wide use for manufacturing a copper wire, and more inexpensive than oxygen-free copper. Moreover, they include a certain level of oxygen (which is higher than that of oxygen-free copper) and this oxygen can be reacted with impurities such as sulfur (S) solved in the copper to make an oxide to reduce the impurity concentration, so that they can be used effectively. The low oxygen copper can be generally produced (cast) with oxygen concentration adjusted when an electrolytic copper is used as the raw material copper as in the tough pitch copper. Alternatively, it can be produced (cast) with oxygen concentration adjusted by using a mixed material of an electrolytic copper and a good scrap copper as a raw material. In any case, adjustment including the selection of raw material copper is needed such that the concentrations of oxygen and sulfur to be included in the copper melt obtained by melting the raw material copper are not more than 20 ppm and not more than 6 ppm, respectively.

In the above embodiment (1), the reason why the concentration of oxygen included in the copper melt is to be not more than 20 ppm is because the cast bar is likely to crack if the concentration of oxygen is more than 20 ppm.

In the above embodiment (1), the reason why the concentration of sulfur included in the copper melt is to be not more than 6 ppm is because sulfur solved in the copper cannot be deposited so as to sufficiently lower the softening temperature of the copper wire rod produced by the continuous casting and rolling method if the concentration of sulfur is high relative to the concentration of oxygen, i.e., more than 6 ppm.

In the above embodiment (1), the reason why the copper melt with the adjusted concentrations of oxygen (not more than 20 ppm) and sulfur (not more than 6 ppm) is used for casting continuously at temperature not higher than 1120° C. is because the cooling speed is thereby increased to have fine copper crystals to expedite deposition of sulfur solved in the copper and the casting temperature is decreased to reduce blow-holes, i.e., defects that may be found in the cast structure of copper.

In the above embodiment (1), the reason why the cast bar obtained by the continuous casting and rolling method is hot-rolled in a temperature range of 850° C. to 550° C. (including a rolling initiation temperature of 850° C. and a rolling termination temperature of 550° C.) is because in order to sufficiently effect a diffusion reaction by which sulfur solved in copper can be deposited as an oxide, the rolling initiation temperature (850° C.) has to be higher than usual to heat sufficiently the cast bar, and if the rolling initiation temperature is low the diffusion reaction cannot be effected sufficiently. On the other hand, if the rolling termination temperature (550° C.) is increased, dissolution limit of sulfur to copper increases to raise the concentration of sulfur to be solved to copper, so that it is not possible to lower sufficiently as expected the softening temperature of a copper wire rod produced.

Thus, by using the method of making a copper wire rod with low semi-softening temperature that comprises, especially, adjusting concentrations of oxygen and sulfur included in the copper melt to be not more than 20 ppm and not more than 6 ppm, respectively, continuously casting the adjusted copper melt at temperature not higher than 1120° C. to have a cast bar, and hot-rolling the cast bar in a temperature range of 850° C. to 550° C. (including a rolling initiation temperature of 850° C. and a rolling termination temperature of 550° C.), the softening temperature of a copper material can be sufficiently lowered at low cost, i.e., without adding the metal with a strong affinity for sulfur and using the expensive oxygen-free copper as a raw material.

In the above embodiment (1), the following modifications and changes can be made.

(i) The temperature range comprises a rolling initiation temperature of 850° C. and a rolling termination temperature of 550° C.

(ii) The concentration of oxygen included in the copper melt is higher than the concentration of sulfur included in the copper melt.

(iii) The concentration of oxygen included in the copper melt is two times to four times higher than the concentration of sulfur included in the copper melt.

(2) According to another embodiment of the invention, a method of making a copper wire comprises:

cold working the copper wire rod with low semi-softening temperature made by the method according to the embodiment (1) at a working ratio of not less than 90%; and annealing the copper wire rod continuously on a same production line.

In the above embodiment (2), the working ratio is defined as below.

Working ratio={1−(cross sectional area of a wire before working/cross sectional area of a wire after working)}×100

By using the method of making a copper wire that comprises cold working the copper wire rod with low semi-softening temperature made by the method according to the embodiment (1) at a working ratio of not less than 90%, and annealing the copper wire rod continuously on a same production line, the copper wire can undergo processing such as drawing etc. and annealing continuously on the same production line without limiting the speed of cold working such as drawing by the annealing. Thus, the productivity of copper can be significantly enhanced. Therefore, the copper wire can be produced inexpensively.

(3) According to another embodiment of the invention, a copper wire made by the method according to the embodiment (2) comprises a semi-softening temperature not more than 160° C.

The copper wire can be inexpensive and reduced in softening temperature so that it can be an industrially useful copper wire with optimum workability according to use of the copper wire.

Points of the Invention

The low-oxygen copper and the tough pitch copper are industrially in wide use for manufacturing a copper wire, and more inexpensive than oxygen-free copper, and they include a certain level of oxygen (which is higher than that of oxygen-free copper) and this oxygen can be reacted with sulfur (S) solved in the copper to deposit an oxide to reduce the sulfur concentration. Thus, a copper wire rod with low sulfur concentration, i.e., low softening temperature can be produced at low cost. Therefore, the concentration (ppm) of oxygen included in a copper melt needs to be higher than the concentration (ppm) of sulfur included in the copper melt, preferably to be two times to four times higher than the concentration (ppm) of sulfur included in the copper melt, more preferably to be two times to three times higher than the concentration (ppm) of sulfur included in the copper melt, so that oxygen can be effectively reacted with sulfur to lower the sulfur concentration, i.e., softening temperature of the product.

BRIEF DESCRIPTION OF THE DRAWINGS

The preferred embodiments according to the invention will be explained below referring to the drawings, wherein:

FIG. 1 is an illustration showing a schematic system for a method of making a copper wire rod with softening temperature in a preferred embodiment according to the invention by using the continuous casting and rolling method; and FIGS. 2A and 2B are cross sectional views showing a low-oxygen copper wire and a low-oxygen rectangular copper wire, respectively, in another preferred embodiment according to the invention.

DETAILED DESCRIPTION OF THE PREFERRED EMBODIMENTS

First Embodiment

A method of making a copper wire rod with softening temperature in the first preferred embodiment according to the invention will be described below referring to the attached drawing.

As shown in FIG. 1, 1 indicates a shaft kiln as a kind of melting furnaces for producing a copper melt by loading a raw material copper 2 such as electrolytic copper, scrap copper etc. from the top, 4 indicates a transfer gutter for transporting the copper melt, 5 indicates a retaining furnace for receiving the copper melt produced in the shaft kiln and retaining it at constant temperature, 6 indicates a casting furnace with a tundish 7 for pouring the melt, 8 indicates a continuous casting machine of belt caster type comprised of a belt 9 and a wheel 10, 11 indicates a guide roller for guiding a copper cast bar 12 continuously outputted from the continuous casting machine 8, 13 indicates a hot rolling mill for shaping the copper cast bar 12 by using plural sets of mill rolls 14 into a copper wire rod 15 with a predetermined size, and 16 indicates a coil of the copper wire rod 15 shaped by a coiler (not shown). According to the production method of the copper wire rod 15 by the continuous casting and rolling method, the lines for melting, casting and rolling the raw material copper 2 are continuously arranged such that the copper wire rod 15 can be produced efficiently by the method with excellent productivity.

According to the first embodiment of the invention, the method of making the copper wire rod is carried out as follows. First, the raw material copper 2 with a sulfur concentration not more than 6 ppm comprised of good scrap copper containing electrolytic copper and tough pitch copper is melted in the shaft kiln 1, the copper melt obtained is settled down in the retaining furnace 5 and adjusted to have an oxygen concentration not more than 20 ppm (same as oxygen level in low-oxygen copper). Then, the copper melt is supplied via the casting furnace 6 and the tundish 7 to the continuous casting machine 8 of belt caster type, where it is continuously cast at a casting temperature of 1120° C. Then, the copper cast bar 12 outputted from the continuous casting machine 8 is continuously introduced to the hot rolling mill 13, where it is hot-rolled in the temperature range of 850° C. to 550° C. (including a rolling initiation temperature of 850° C. and a rolling termination temperature of 550° C.) to deposit sulfur (S) solved in the copper melt so as to produce the copper wire rod 15 of low-oxygen copper that has a low softening temperature and a diameter of ϕ8 mm. Here, the casting temperature is measured inside the copper (not the surface temperature thereof) melt in the casting furnace 6. The rolling initiation temperature is measured just before the first mill roll 14 in the travelling direction of the cast bar 12, and the rolling termination temperature is measured just after the final mill roll 14 in the travelling direction of the cast bar 12.

By the above method of making the copper wire rod, the softening temperature of the copper material can be sufficiently lowered at low cost, i.e., without adding the metal with a strong affinity for sulfur and using the expensive oxygen-free copper as a raw material.

According to the first embodiment of the invention, the method of making the copper wire is carried out as follows. The copper wire rod 15 with a diameter of ϕ8 mm thus produced is cold drawn (at a working ratio of 90%) to have a copper wire with a diameter of ϕ2.6 mm. Then, the copper wire is continuously annealed at a heating temperature of 400° C. for 1 hour on the same production line to produce a predetermined low-oxygen copper wire 17 (FIG. 2A).

By the above method of making the copper wire, the copper wire can undergo processing such as drawing etc. and annealing continuously on the same production line without limiting the speed of cold working such as drawing by the annealing.

Thus, the productivity of copper can be significantly enhanced. Therefore, the copper wire can be produced inexpensively.

Here, the semi-softening temperature of the low-oxygen copper wire (with an oxygen concentration not more than 20 ppm) thus produced is measured 150° C. (Example 1) with reference to the heating-softening curves. For comparison, the semi-softening temperature of the oxygen-free copper wire produced by cold drawing and annealing as well is measured 214° C. (Comparative Example 1). The semi-softening temperatures of both Examples are shown in Table 1.

TABLE 1

| Sample | Semi-softening temperature (° C.) |
|---|---|
| Comparative Example 1 | 214 |
| Example 1 | 150 |

The copper wire in Example 1 is inexpensive because of being not of oxygen-free copper and reduced in softening temperature so that it can be an industrially useful copper wire with optimum workability according to use of the copper wire.

In modification of the first embodiment, the copper wire rod of low-oxygen copper may be produced by the same method except using a continuous casting machine of twin belt type instead of the continuous casting machine of belt caster type as shown in FIG. 1.

Second Embodiment

A method of making a copper wire rod with softening temperature in the second preferred embodiment according to the invention will be described below referring to the attached drawing.

In the second embodiment, the copper wire rod 15 is produced by using the continuous casting and rolling method (shown in FIG. 1) as in the first embodiment.

According to the second embodiment of the invention, the method of making the copper wire rod is carried out as follows. First, the raw material copper 2 with a sulfur concentration not more than 6 ppm comprised of good scrap copper containing electrolytic copper and tough pitch copper is melted in the shaft kiln 1, the copper melt obtained is settled down in the retaining furnace 5 and adjusted to have an oxygen concentration not more than 20 ppm (same as oxygen level in low-oxygen copper). Then, the copper melt is supplied via the casting furnace 6 and the tundish 7 to the continuous casting machine 8 of belt caster type, where it is continuously cast at a casting temperature of 1120° C. Then, the copper cast bar 12 outputted from the continuous casting machine 8 is continuously introduced to the hot rolling mill 13, where it is hot-rolled in the temperature range of 850° C. to 550° C. (including a rolling initiation temperature of 850° C. and a rolling termination temperature of 550° C.) to deposit sulfur (S) solved in the copper melt so as to produce the copper wire rod 15 of low-oxygen copper that has a low softening temperature and a diameter of ϕ12 mm.

By the above method of making the copper wire rod, the softening temperature of the copper material can be sufficiently lowered at low cost, i.e., without adding the metal with a strong affinity for sulfur and using the expensive oxygen-free copper as a raw material.

According to the second embodiment of the invention, the method of making the copper wire is carried out as follows. The copper wire rod 15 with a diameter of ϕ12 mm thus produced is cold drawn (at a working ratio of 77%) to have a rectangular copper wire with a thickness of 2.4 mm and a width of 11 mm. Then, the rectangular copper wire is continuously annealed at a heating temperature of 400° C. for 1 hour on the same production line to produce a predetermined low-oxygen rectangular copper wire 18 (FIG. 2B).

By the above method of making the rectangular copper wire, the rectangular copper wire can undergo processing such as drawing etc. and annealing continuously on the same production line without limiting the speed of cold working such as drawing by the annealing. Thus, the productivity of copper can be significantly enhanced. Therefore, the rectangular copper wire can be produced inexpensively.

Here, the semi-softening temperature of the low-oxygen rectangular copper wire (with an oxygen concentration not more than 20 ppm) thus produced is measured 159° C. (Example 2) with reference to the heating-softening curves. For comparison, the semi-softening temperature of the oxygen-free rectangular copper wire produced by cold drawing and annealing as well is measured 225° C. (Comparative Example 2). The semi-softening temperatures of both Examples are shown in Table 2.

TABLE 2

| Sample | Semi-softening temperature (° C.) |
|---|---|
| Comparative Example 2 | 225 |
| Example 2 | 159 |

Third Embodiment

A method of making a copper wire rod with softening temperature in the third preferred embodiment according to the invention will be described below referring to the attached drawing.

In the third embodiment, the copper wire rod 15 is produced by using the continuous casting and rolling method (shown in FIG. 1) as in the first and second embodiments.

According to the third embodiment of the invention, the method of making the copper wire rod is carried out as follows. First, the raw material copper 2 with a sulfur concentration not more than 6 ppm comprised of good scrap copper containing electrolytic copper and tough pitch copper is melted in the shaft kiln 1, the copper melt obtained is settled down in the retaining furnace 5 and adjusted to have an oxygen concentration not more than 20 ppm (same as oxygen level in low-oxygen copper). Then, the copper melt is supplied via the casting furnace 6 and the tundish 7 to the continuous casting machine 8 of belt caster type, where it is continuously cast at a casting temperature of 1120° C. Then, the copper cast bar 12 outputted from the continuous casting machine 8 is continuously introduced to the hot rolling mill 13, where it is hot-rolled in the temperature range of 850° C. to 550° C. (including a rolling initiation temperature of 850° C. and a rolling termination temperature of 550° C.) to deposit sulfur (S) solved in the copper melt so as to produce the copper wire rod 15 of low-oxygen copper that has a low softening temperature and a diameter of ϕ023 mm.

By the above method of making the copper wire rod, the softening temperature of the copper material can be sufficiently lowered at low cost, i.e., without adding the metal with a strong affinity for sulfur and using the expensive oxygen-free copper as a raw material.

According to the third embodiment of the invention, the method of making the copper wire is carried out as follows. The copper wire rod 15 with a diameter of ϕ23 mm thus produced is cold drawn (at a working ratio of 90%) to have a rectangular copper wire with a thickness of 2.4 mm and a width of 20 mm. Then, the rectangular copper wire is continuously annealed at a heating temperature of 400° C. for 1 hour on the same production line to produce a predetermined low-oxygen rectangular copper wire 18 (FIG. 2B).

By the above method of making the rectangular copper wire, the rectangular copper wire can undergo processing such as drawing etc. and annealing continuously on the same production line without limiting the speed of cold working such as drawing by the annealing. Thus, the productivity of copper can be significantly enhanced. Therefore, the rectangular copper wire can be produced inexpensively.

Here, the semi-softening temperature of the low-oxygen rectangular copper wire (with an oxygen concentration not more than 20 ppm) thus produced is measured 151° C. (Example 3) with reference to the heating-softening curves. For comparison, the semi-softening temperature of the oxygen-free rectangular copper wire produced by cold drawing and annealing as well is measured 216° C. (Comparative Example 3). The semi-softening temperatures of both Examples are shown in Table 3.

TABLE 3

| Sample | Semi-softening temperature (° C.) |
|---|---|
| Comparative Example 3 | 216 |
| Example 3 | 151 |

Although in the first to third embodiments the copper wire rod 15 is cold drawn, a low-oxygen rectangular copper wire may be cold rolled instead of being cold drawn. For example, a copper wire rod with a diameter of ϕ23 mm may be cold rolled into a rectangular conductor of 6 mm in thickness and 69 mm in width or 5 mm in thickness and 83 mm in width. Also, the thickness and width of the rectangular conductor may be adjusted according to the cross sectional area of the copper wire rod. For example, a copper wire rod with a diameter of ϕ12 mm may be cold rolled into a rectangular conductor of 3 mm in thickness and 37 mm in width or 2 mm in thickness and 56 mm in width. A copper wire rod with a diameter of ϕ8 mm may be cold rolled into a rectangular conductor of 3 mm in thickness and 16 mm in width or 2 mm in thickness and 25 mm in width.

The low-oxygen rectangular conductor of the invention may be used as a bus bar etc. wired in a switchboard of a building, a control panel for a machine tool, and an automobile inverter for feeding large current and dissipating heat, or as a bus bar as an electricity collecting wiring member of a solar cell panel, or as a distribution conductor in a building, or as a rectangular enameled wire or an extruded resin-covered (e.g., PTFE, PFA etc.) rectangular wire for a motor or an alternator etc., or a insulation-covered rectangular wire substituted for a cable. Further, it may be used as a conductor material for a FPC (flexible printed circuit), MFJ (multi-frame joiner), FFC (flexible flat cable) etc.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

The invention claimed is:

1. A method of making a low-oxygen copper wire rod with a low semi-softening temperature, said method comprising:

melting a raw material copper to have a copper melt;

adjusting concentrations of oxygen included in the copper melt and sulfur included in the copper melt such that the concentration of the sulfur to be not more than 6 ppm without adding any other metals;

continuously casting the adjusted copper melt having a composition with an oxygen concentration more than 10 ppm and not more than 20 ppm, a sulfur concentration not more than 6 ppm, and a balance of copper and inevitable impurities at a temperature not higher than 1120° C. to have a cast bar; and hot-rolling the cast bar in a temperature range of 850° C. to 550° C., wherein the temperature range comprises a rolling initiation temperature of 850° C. and a rolling termination temperature of 550° C.

2. A method of making a copper wire, comprising:

cold working the copper wire rod with the low semi-softening temperature made by the method according to claim 1 at a working ratio of not less than 90%; and annealing the copper wire rod continuously on a same production line.

3. A copper wire made by the method according to claim 2, wherein the low semi-softening temperature is not more than 160° C.

4. The method according to claim 1, wherein the concentration of oxygen included in the copper melt is higher than the concentration of sulfur included in the copper melt.

5. The method according to claim 1, wherein the concentration of oxygen included in the copper melt is two times to four times higher than the concentration of the sulfur included in the copper melt.

6. The method according to claim 1, wherein said hot-rolling the cast bar comprises passing the cast bar through a plurality of mill rolls.

7. The method according to claim 6, wherein the rolling initiation temperature is measured just before a first mill roll of said mill rolls in a travelling direction of the cast bar, and the rolling termination temperature is measured just after a final mill roll of said mill rolls in the travelling direction of the cast bar.

8. The method according to claim 1, wherein the rolling initiation temperature is set such that said sulfur included in the copper melt is deposited as an oxide in a diffusion reaction.

9. The method according to claim 1, wherein the raw material copper comprises an electrolytic copper.

* * * * *